United States Patent [19]

Cunningham

[11] 4,178,901

[45] Dec. 18, 1979

[54] DIESEL TRUCK ROAD SPEED CONTROL

[76] Inventor: Paul B. Cunningham, 607 Orchard Hill Dr., Pittsburgh, Pa. 15238

[21] Appl. No.: 875,887

[22] Filed: Feb. 7, 1978

[51] Int. Cl.[2] ..... F02B 77/08

[52] U.S. Cl. ..... 123/198 D; 123/198 DB; 180/178

[58] Field of Search .... 123/198 D, 198 DB, 198 DC, 123/101; 180/105 R, 105 E

[56] References Cited

U.S. PATENT DOCUMENTS

| | | | |
|---|---|---|---|
| 3,207,255 | 9/1965 | Hahlganss et al. | 180/105 R |
| 3,371,634 | 3/1968 | Lalande | 123/198 D |
| 3,385,278 | 5/1968 | Johnson et al. | 123/198 D |
| 3,533,390 | 10/1970 | Goodwin | 123/198 DB |
| 3,590,798 | 7/1971 | Goodwin | 123/198 D |
| 3,877,455 | 4/1975 | Goodwin | 123/198 DB |

*Primary Examiner*—Ira S. Lazarus
*Attorney, Agent, or Firm*—Bauer & Amer

[57] ABSTRACT

Effective supervision of the road speed of a diesel truck requires termination of the operation of the engine when the truck is operated at an excessive speed. Utilizing to advantage what is already available, namely an engine shut-down control when the engine lubricating oil pressure is below a specified pressure, the device hereof provides the referred to road speed supervision in an effective manner and with minimum expense and complication. Specifically, the within road speed control contemplates creating an "artificial" loss of lubricating oil pressure, i.e. one that is not due to an actual defect or malfunction of the lubricating oil circulating system, but rather one that is responsive to the operation of the truck at an excessive speed. Said "artificial" loss of lubricating oil pressure is, of course, just as effective as an actual pressure loss in causing engine shut-off or slow-down, thereby providing effective road speed supervision for the diesel truck.

3 Claims, 3 Drawing Figures

DIESEL TRUCK ROAD SPEED CONTROL

Figure 1:
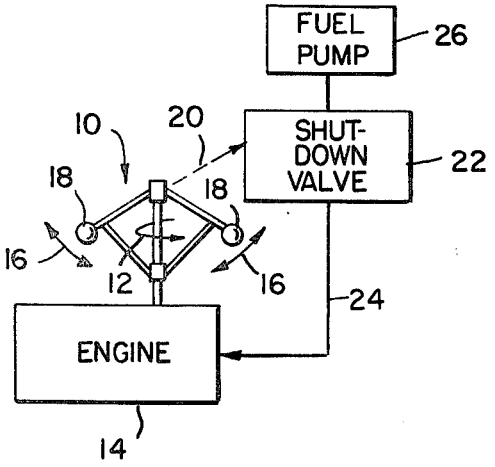
FIG. 1 PRIOR ART

The present invention relates to an improved diesel truck, and more particularly to an effective control imposing an upper limit on the road speed operation of said diesel truck, or similarly powered vehicle.

Underlying the present invention is the recognition that the same overall objective, namely termination or a significant slowing down of engine operation, is required for a number of different operating parameters of the diesel engine. Specifically, as detailed in U.S. Patent Application Ser. No. 752,252, now U.S. Pat. No. 4,080,946, at various operating speeds the engine lubricating oil should be at specified pressure levels. If the lubricating oil pressure does not attain the levels required, or if it undergoes a significant drop or decrease therefrom, well known controls are employed to terminate or slow down operation of the diesel engine. In accordance with the present invention, the foregoing is used to advantage to also provide effective road speed supervision of the vehicle by causing the same desired end result of engine shut-down, but in response to excessive road speed rather than to lubricating oil pressure or any other changing operating parameter of the vehicle.

Broadly, it is an object of the present invention to avoid using governors or other such mechanical speed-limiting controls, with their attendant limitations, thereby overcoming shortcomings and other known disadvantages of such controls. Specifically, it is an object to create in connection with a known supervising operating parameter-shut-down control cooperating arrangement, a simple, yet effective, diesel truck road speed control, thereby enabling already known, and operational effective, engine shut-down controls to be used for the unobvious and additional significant function of providing supervised road speed control for the diesel vehicle.

The engine shut-down control used in accordance with the present invention is of the well known type wherein fuel for powering the diesel truck engine flows through an internal valve opening therein that is normally spring-biased closed except as a valve piston is biased by the oil pressure of the truck engine through movement towards the internal valve opening for maintaining the same in an open condition. The improvements demonstrating objects and advantages of the present invention for effectively obtaining road speed supervision of the diesel truck using said shut-down control valve include a conduit operatively connected to provide an escape passage from said control valve for said oil pressure therein incident to causing the shut-down operation of said control valve upon the escape of said oil pressure therefrom, a normally closed valve in said conduit for normally maintaining closed said escape passage thereof, and a truck road speed-sensing control operatively connected to open said normally closed valve when said truck is travelling in excess of a selected speed. As a result, an artificially induced condition of loss of oil pressure is caused to occur and, more important, the occurrence thereof is made responsive to the truck road speed so as to advantageously impose an upper limit on the road speed operation of the diesel truck.

Figure 3:
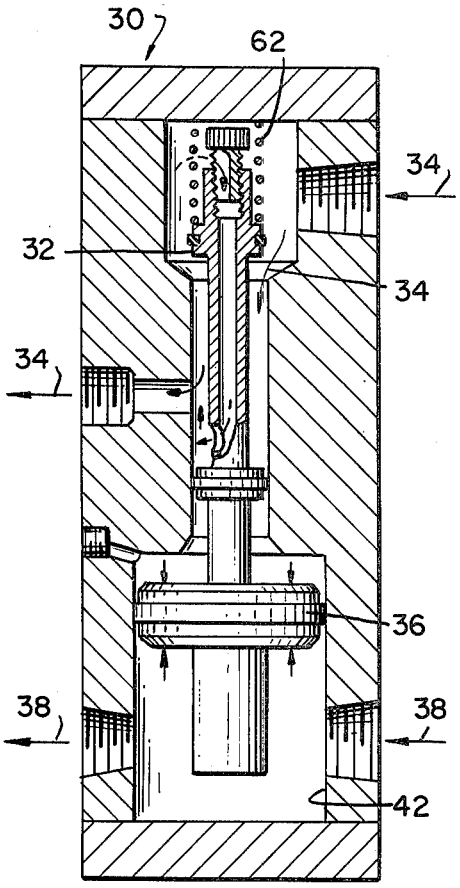
Figure 2:
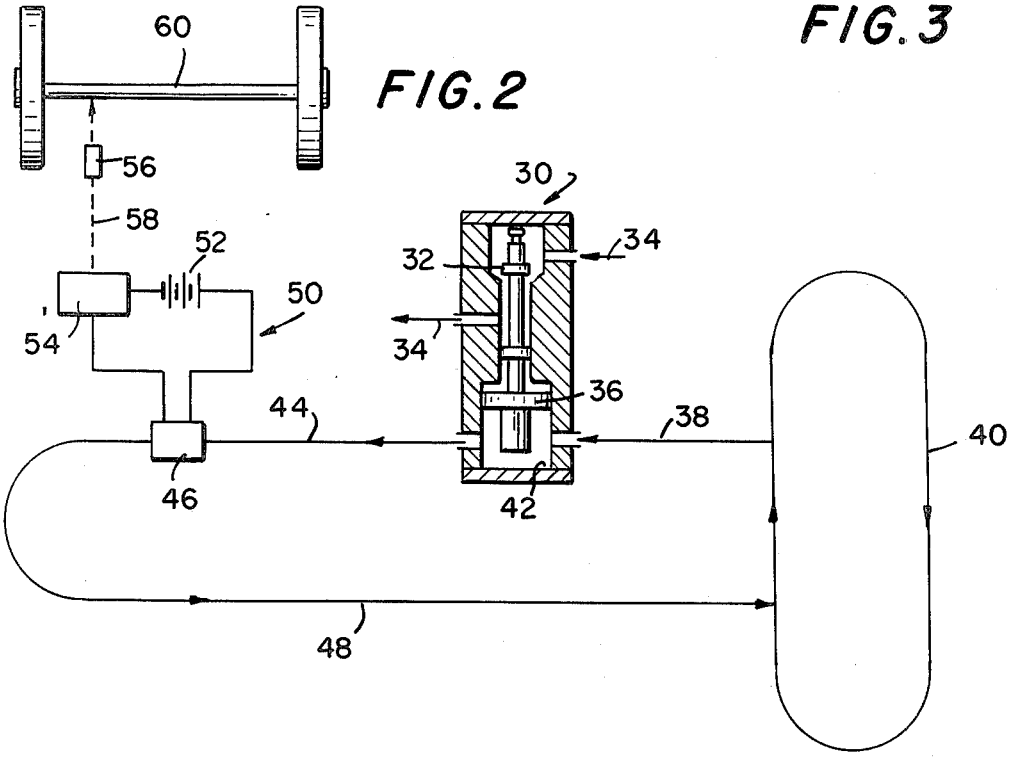

The above brief description, as well as further objects, features and advantages of the present invention, will be more fully appreciated by reference to the following detailed description of a presently preferred, but nonetheless illustrative embodiment in accordance with the present invention, when taken in conjunction with the accompanying drawings, wherein:

FIG. 1 is a diagrammatic view of a prior art shut-down control for a diesel engine;

FIG. 2 is a diagrammatic view of the improved shut-down control which is responsive to the road speed traveled by the vehicle powered by the diesel engine and, as such, constitutes an improved diesel vehicle or truck road speed control according to the present invention; and FIG. 3 is a sectional view, on an enlarged scale, of a shut-down control valve component utilized in the road speed control of FIG. 2.

In the prior art structure depicted in FIG. 1 reference numeral 10 is intended to designate a typical speed governor of the well known type which is operatively powered in rotation 12 by the engine 14 of a diesel truck or similar vehicle. Depending upon speed of rotation 12, governor 10 is subjected to centrifugal forces 16 that will either lift or lower weights 18. The position of the weights 18 will, in turn, control the rate of flow of fuel to the diesel engine 14 via a well understood operative connection 20 to a shut-down valve 22 operatively disposed in the fuel line or conduit 24 connected between the fuel pump 26 and the engine 14. Thus, a typical operation of the governor 10 is one in which it is effective in cutting off the fuel flow when the engine speed sensed by it exceeds a specified amount. The significant shortcoming of governor 10, however, is that during its operation, unless precautions are taken, it will prevent the diesel engine 14 from operating at speeds necessary to develop the high torque that correspondingly is necessary to propel the diesel truck or vehicle up an incline or otherwise to perform extensive work. That is, the operation of engine 14 may be providing a high torque for work purposes, but producing a comparatively low, and thus safe, road speed for the vehicle. Under these conditions, unless the governor 10 has been disabled by a switch or other such means, it will prematurely terminate the operation of the engine even though the vehicle is not operated at an unsafe road speed. As may be readily surmised, once the governor 10 is provided with a disabling switch, the operator of the vehicle is of course capable of actuating this switch whenever he desires to operate the vehicle without any upper limit imposed on the road speed of the vehicle, thereby defeating use of the governor 10 as an effective safety device.

As will be subsequently described in detail, the present invention contemplates a noteworthy extended use to provide road speed supervision of the vehicle of a valve that is now being used for its engine shut-down function, but in relation to the lubricating oil pressure of the engine. That is, there is currently in use a shut-down control valve, such as for example the valve of U.S. patent application Ser. No. 752,252, now U.S. Pat. No. 4,080,946, which terminates the operation of the diesel engine whenever the pressure of the lubricating oil is below a specified value. A significant aspect of the present invention is the recognition that the same overall objective, namely termination of the engine operation, is required for an effective road speed control since the engine operation should be terminated when a safe road speed is exceeded, and that this objective is of course what is now a conventional part of the operation of a shut-down control related to the lubricating oil pressure of the engine. In other words, the valve referred to is effective in terminating the operation of the diesel engine whenever the lubricating oil pressure falls below a specified value, and with this understanding the present invention thus contemplates causing what can be termed an artificially induced drop or loss of lubricating oil pressure in order to obtain the corresponding result of engine termination. The referred to loss in lubricating oil pressure is "artificial" because it is not actually due to any defect or malfunction in the lubricating oil system, but rather is due to an induced loss of oil pressure that according to the present invention is made responsive to the road speed of the vehicle. More particularly, and as will be described in greater detail subsequently, whenever the truck or vehicle road speed exceeds a selected amount, this has the consequence of causing a significant reduction in the lubricating oil pressure with the desired result of causing fuel shut-off and thus the engine-shut down function of the control valve.

Reference should now be made to FIG. 2 which diagrammatically illustrates the improved road speed control for a diesel truck according to the present invention, the same overcoming the foregoing and other shortcomings noted in connection with the prior art governor of FIG. 1. More particularly, as illustrated in FIG. 2, the speed control includes a fuel flow control valve 30 which, when the fuel valve 32 is opened, allows fuel to flow to the diesel engine, as along the flow path 34.

As generally understood, and as described in connection with the particular embodiment of the flow control valve 30 illustrated herein which substantially duplicates the description thereof in U.S. Patent application Ser. No. 752,252, now U.S. Pat. No. 4,080,946, which by this reference is incorporated in its entirety herein, in the operation of said valve 30 a raised position in the piston 36 thereof is effective in maintaining the fuel valve 32 in its fully open condition. Said piston 36 is, in turn, maintained in its raised position by pressure of the vehicle lubricating oil which is tapped off via the conduit 38 from the lubricating oil system 40 of the vehicle. More particularly, the high pressure of the lubricating oil that exists within chamber 42, and thus beneath the piston 36, will of course maintain the piston in its elevated position as long as this lubricating oil is not permitted to escape from the chamber 42 or, what is the equivalent, is not "dumped" via the escape passage provided or bounded by the outlet conduit 44. To prevent this "dumping" of the high pressure lubricating oil, conduit 44 or, more accurately, the internal flow passage thereof, is normally closed by a solenoid valve 46. That is, until solenoid valve 46 is electrically pulsed from its normally closed into its open condition, in a manner which will soon be described, the high pressure lubricating oil is prevented from flowing through the outlet conduit 44 and through the return conduit 48 back to the circulating system 40.

In accordance with the present invention, the preferred manner of pulsing the solenoid valve 46 from its normally closed into its open condition is achieved by incorporating the solenoid valve, or at least the field coil thereof, in a control circuit 50. Said circuit 50 includes a battery 52 and an electronic speed switch 54, said switch 54 being of the type which will close from a normally open condition when a speedometer 56 operatively associated with switch 54, via the operative connection 58, indicates a speed of operation of the vehicle axle 60, or some other appropriate part of the vehicle, above a specified number of revolutions. The electronic speed switch 54 of the type just referred to is available from numerous manufacturers, one appropriate source being Synchro-Start Products, Inc. of Skokie, Illinois. Such electronic speed switches are typically used to prevent movement in a bus or other such vehicle when the doors thereof are opened.

To summarize, and as should be readily apparent from the description already provided, electronic speed switch 54 is thus normally open and thus circuit 50 is normally open or incomplete at all speeds of the vehicle's axle 60 or other appropriate rotating part below a specified speed, as sensed by the speedometer 56. However, when vehicle 60 exceeds the speed determined to be required for its "safe" operation, switch 54 is closed thereby completing circuit 50 and thus resulting in solenoid 46 being electrically pulsed by the battery 52. In response to the electrical pulsing of the solenoid 46, the valve controlled by the solenoid is in turn opened, and thus the high pressure lubricating oil in chamber 42 is "dumped" through the outlet conduit 44. This release of the lubricating oil will allow return spring 62 (see FIG. 3) to lower the piston 36, and thus will cause the seating of valve 32 and a predetermined significant decrease in the fuel supply 34 to the engine. Naturally, decrease of the engine fuel supply results in the desired decrease in the operating road speed of the vehicle.

For completeness sake, structural details of the shut-down control valve 30 are shown on an enlarged scale in FIG. 3, and the structural features thereof already referred to in the description related to FIG. 2 are, for simplicity sake, designated by the same reference numerals in FIG. 3. Although the detailed description of the construction and mode of operation of the shut-down control valve 30 is not deemed necessary for an understanding of the present invention, it is to be understood that such detailed description is provided in U.S. Patent application Ser. No. 752,252, now U.S. Pat. No. 4,080,946.

A latitude of modification, change and substitution is intended in the foregoing disclosure and in some instances some features of the invention will be employed without a corresponding use of other features. Accordingly, it is appropriate that the appended claims be construed broadly and in a manner consistent with the spirit and scope of the invention herein. In the foregoing description, as well as in the claims, reference to the term "oil pressure" is intended to mean both the fluid or medium which provides a measurable pressure, and also the pressure itself exerted by said fluid or medium.

What is claimed is:

1. An improved engine shut-down control valve for providing road speed supervision of a diesel truck, said control valve being of the type wherein fuel for powering said truck engine flows through an internal valve opening therein that is normally spring-biased closed except as a piston therein is biased by the oil pressure of said truck engine through movement towards said internal valve opening for maintaining the same in an open condition, the improvements for effectively obtaining road speed supervision of said diesel truck by said shut-down control valve comprising a conduit operatively connected to provide an escape passage from said control valve for said oil pressure therein incident to causing the shut-down operation of said control valve upon the escape of said oil pressure therefrom, a normally closed valve in said conduit for normally maintaining closed said escape passage thereof, and a truck road speed-sensing control operatively connected to open said normally closed valve when said truck is travelling in excess of a selected speed, whereby an artificially induced condition of loss of oil pressure is made responsive to said truck road speed so as to advantageously impose an upper limit on the road speed operation of said diesel truck.

2. A diesel truck road speed control as claimed in claim 1 wherein said truck road speed-sensing control is operatively arranged to sense the rotational speed of a selected part on said truck indicative of the road speed thereof and is also of the type effective to emit an electrical pulse when said sensed rotational speed exceeds a predetermined extent, and said normally closed valve is of a solenoid type adapted to be electrically pulsed from said normally closed condition into an open condition, whereby said escape passage of said conduit is opened for the exiting flow of said oil pressure as a function of the road speed of said truck.

3. A diesel truck road speed control as claimed in claim 2 wherein said truck road speed-sensing control is operatively arranged to sense the rotational speed of an axle of said truck.

* * * * *